US005193456A

United States Patent [19]

Wolfe et al.

[11] Patent Number: 5,193,456

[45] Date of Patent: Mar. 16, 1993

[54] APPARATUS FOR DECORATING BEVERAGE CANS USING A FLEXOGRAPHIC PROCESS

[75] Inventors: Court L. Wolfe, Pittsburgh; Regis J. Leonard, Munhall; John M. Jourdain, Irwin; Edward W. Evans, Pittsburgh; Justin R. DeCheck, Irwin, all of Pa.

[73] Assignee: Crown Cork & Seal Company, Inc., Philadelphia, Pa.

[21] Appl. No.: 803,488

[22] Filed: Dec. 4, 1991

[51] Int. Cl.[5] ..... B41F 17/22

[52] U.S. Cl. ..... 101/40; 101/247

[58] Field of Search ..... 101/40, 40.1, 39, 38.1, 101/35, 376, 483, 484, 490, 247

[56] References Cited

U.S. PATENT DOCUMENTS

| | | | |
|---|---|---|---|
| 3,223,028 | 12/1965 | Brigham | 101/40 |
| 3,227,070 | 1/1966 | Brigham et al. | 101/40 |
| 3,276,647 | 10/1966 | Lewis, Jr. et al. | 226/31 |
| 3,496,863 | 2/1970 | Cvacho et al. | 101/40 |
| 3,501,108 | 3/1970 | Roscoe et al. | 242/75.5 |
| 3,534,681 | 10/1970 | Beals | 101/37 |
| 3,645,201 | 2/1972 | Jackson | 101/40.1 |
| 3,716,704 | 2/1973 | Dixon | 235/92 |
| 4,037,530 | 7/1977 | Sirvet | 101/40 |
| 4,138,941 | 2/1979 | McMillin et al. | 101/40 |
| 4,140,053 | 2/1979 | Skrypek et al. | 101/40 |
| 4,186,661 | 2/1980 | Vieau | 101/178 |
| 4,267,711 | 5/1981 | Stirbis | 101/40 |
| 4,370,925 | 2/1983 | Kazumi et al. | 101/40 |
| 4,426,149 | 1/1984 | Kuemmel et al. | 355/8 |
| 4,441,418 | 4/1984 | Hahn | 101/38 R |
| 4,491,613 | 1/1985 | Hahn | 427/428 |
| 4,499,826 | 2/1985 | Regge | 101/181 |
| 4,519,310 | 5/1985 | Shimizu et al. | 101/40 X |
| 4,706,566 | 11/1987 | Kishine et al. | 101/426 |
| 4,721,895 | 1/1988 | Cocksedge et al. | 318/618 |
| 4,852,785 | 8/1989 | Bettendorf et al. | 226/42 |
| 4,884,504 | 12/1989 | Sillars | 101/483 |
| 4,893,559 | 1/1990 | Sillars | 101/216 |
| 4,926,788 | 5/1990 | Metcalf | 118/500 |

FOREIGN PATENT DOCUMENTS 57-4773 11/1982 Japan .

OTHER PUBLICATIONS

"Preprint Presses Fuse Electronics To Mechanics For Bright Future," K. Flathmann, published in Flexo magazine, Oct. 1989.

"Multi-Axis Motion Control Using Industrial Computers," R. McClellan and R. Baker, published in Motion Control magazine, Mar. 1991.

"Flexography Principles and Practice," Flexographic Technical Association, 3d ed., 1980, pp. 382-386.

"Announcing the Electronic Gear Train a Startling New Concept in Power Transmission," Honeywell Brochure, Nov. 1964.

"Max/Control," Creonics brochure, Sep. 1988.

"DMC-230," Galil brochure, Jul. 1987.

*Primary Examiner*—Clifford D. Crowder

*Attorney, Agent, or Firm*—Woodcock Washburn Kurtz Mackiewicz & Norris

[57] ABSTRACT

A decorator for cylindrical objects, such as beverage cans and the like. The cylindrical members are carried by mandrels which are sequentially presented to rotating printing plates. A plurality of mandrels are carried by a mandrel cluster and the printing plates are carried by plate wheels. The decorator is capable of utilizing flexographic inks wherein the surface of the cylindrical body can be printed with a first ink, the ink rapidly dried, followed by the application of the second ink. The mandrels are compliantly supported on the mandrel cluster by pneumatic cylinders supplied with both high and low pressure air so that the spring rate of the complaint support may be varied to ensure uniform printing. Synchronization of the rotation of a mandrel with the rotation of a printing plate carried by a plate cylinder is critical so that the second image is precisely in register with respect to a first applied image. A particular feature is the utilization of synchronized electric motors to rotate the various parts of the decorator with each electric motor having an encoder and wherein an electronic controller controls the rotational position of each motor so as to effect the synchronization of the several motors and the precise registration of the components.

23 Claims, 8 Drawing Sheets

200
START UP EACH MOTOR
202
RPM_MC = N ?
N
204
ADJUST CONTROL SIGNAL TO MANDREL CLUSTER MOTOR
Y
208
COUNT NO. OF PULSES, P_MC , P_N
210
P_1 / P_MC > X_1 ?
Y
212
DECREASE SPEED OF MOTOR #1
N
214
P_1 / P_MC < X_2 ?
Y
216
INCREASE SPEED OF MOTOR #1
N
218
P_8 / P_MC > X_8 ?
Y
220
DECREASE SPEED OF MOTOR #8
N
222
P_8 / P_MC < X_8 ?
Y
224
INCREASE SPEED OF MOTOR #8
N

APPARATUS FOR DECORATING BEVERAGE CANS USING A FLEXOGRAPHIC PROCESS

FIELD OF THE INVENTION

The current invention concerns an apparatus and method for decorating cylindrical members, such as beverage cans and the like. More particularly the invention concerns a decorator for decorating can bodies using a flexographic process.

BACKGROUND OF THE INVENTION

Generally, can-type beverage containers are of a two-piece construction, with one piece including an integral body and bottom and the other piece being a separately applied lid. Since such cans are cylindrical, they must be printed or decorated by rolling the required decorative ink onto the can body.

Traditionally, can bodies were decorated in multiple colors using a decorator that sequentially applied colored inks in the desired image to a transfer blanket by way of a separate printing plate for each color. Such a can decorating press is disclosed in U.S. Pat. Nos. 3,223,028 (Brigham) and 3,227,070 (Brigham et al.). The application of the various color inks to the blanket is synchronized by mechanical gears. After the multicolored image has been applied to the blanket, the blanket applies the image to the can in one revolution of the can. The can is mounted on a free spinning mandrel. Although the can may be pre-spun prior to printing, as disclosed in U.S. Pat. No. 4,138,941 (McMillin et al.) during the printing process its rotation is driven by frictional contact with the transfer blanket.

The art work on the aforementioned printing plates is so arranged that each color is separated from the adjacent color by very narrow non-printing areas, known as "trap lines". These "trap lines" serve to confine each color to its own design configuration and prevents undesirable bleeding of one color into another. The inks required for use with transfer blankets must be formulated to have a high tack and a paste like viscosity. The high viscosity ensures that the ink will stay within the trap lines, thus avoiding the bleeding of one color into another. The high tackiness also serves to increase the driving friction between the transfer blanket and the can that is necessary to allow the blanket to rotate the can.

Unfortunately, the such high tack viscous inks are very slow drying and require large curing ovens. Further, the inks emit undesirable solvent vapors into the environment.

Decorating cans using a flexographic process offers several advantages. First, flexographic inks are water based and do not emit significant quantities of volatile organic hydrocarbons. Consequently, they are environmentally benign. Second, they are quick drying and do not require oven curing after application. Third, since they are quick drying, the trap lines between each color image can be dispensed with resulting in a more aesthetically pleasing appearance, as well as the ability to overprint several colors in a "dry trap" process.

Unfortunately, use of flexographic inks presents a number of serious difficulties that have heretofore made them impractical for use in decorating cans in a high speed operation, except in rather limited applications, such as printing random numbers on cans otherwise decorated using the traditional blanket transfer process, as disclosed in U.S. Pat. No. 4,884,504 (Sillars). First, they cannot be applied to a transfer blanket as the inks would run together. Accordingly, in order to utilize the flexographic inks, they must be applied directly to the can using a separate printing plate for each color. Consequently, the point of contact of each printing plate with the can must be precisely in registration with the point of contact of the other printing plates.

Satisfying this precise registration requirement is made more difficult by the fact that flexographic inks are not tacky. The lack of tackiness can cause a friction driven can to slip relative to the printing plate, resulting in an image that is out of register. Consequently, the cans must be positively driven while they are in contact with the printing plate to ensure that the surface speed of the can matches that of the printing plate. The net result is that a decorator utilizing flexographic ink has a number of components which must be precisely indexed and synchronized. Although mechanical gearing can be utilized to properly index and synchronize the components, such gears are subject to wear, causing poor quality decoration.

A second difficulty associated with flexography is that it is difficult to ensure uniform contact pressure of the entire can surface over a single printing plate and difficult to ensure uniform contact pressure between different printing plates. Non-uniform contact pressure results in non-uniform decorating.

It would be desirable to provide a decorator for beverage cans, using a flexographic process, that did not require the use of mechanical gearing to synchronize and index the components and that ensured uniform contact pressure of the printing plates against the cans.

SUMMARY OF THE INVENTION

It is an object of the current invention to provide an apparatus and method for decorating cylindrical objects, such as beverage cans, using a flexographic process.

It is another object of the current invention that the apparatus not rely on mechanical gearing to synchronize and index its various components.

It is still another object of the current invention that the apparatus ensure that the printing plates contact the object to be decorated with uniform pressure.

These and other objects are accomplished in a decorator for applying an image to cylindrical objects using a flexographic process, comprising (i) a first printing plate mounted on a first support structure, at least a first portion of the image being formed on the first printing plate, (ii) carrying means for carrying the cylindrical objects into contact with the first printing plate, and (iii) compliant support means for supporting the carrying means on a second support structure, the compliant support means having pneumatic means for imparting compliancy thereto.

In one embodiment of the invention, the first support structure comprises a first plate wheel, the carrying means comprises a mandrel adapted to be inserted into one of the cylindrical objects, the second support structure comprises a mandrel cluster, and the pneumatic means comprises a piston operating within a piston cylinder. In addition, in this embodiment, the decorator comprises (i) a second plate wheel on which a second printing plate, having a second portion of the image formed therein, is mounted, (ii) a first source of pressurized air, (iii) means for placing the piston cylinder in flow communication with the first pressurized air source, whereby air in the piston cylinder from the first pressurized air source provides compliancy for the compliant support means, (iv) a shaft for driving rotation of the mandrel, (v) a support plate for supporting the shaft, (vi) a support frame having means for slidably supporting the support plate thereon, the piston and piston cylinder mounted on the support frame, the piston operatively coupled to the support plate, (vii) motors operatively coupled to rotate the first and second plate wheels, the mandrel cluster, and the mandrel, and (viii) an electronic controller programed with logic for controlling the rotation of each of the motors, whereby the first and second portions of the image are transferred to the surface of the cylindrical objects.

DESCRIPTION OF THE PREFERRED EMBODIMENT

Figure 1:
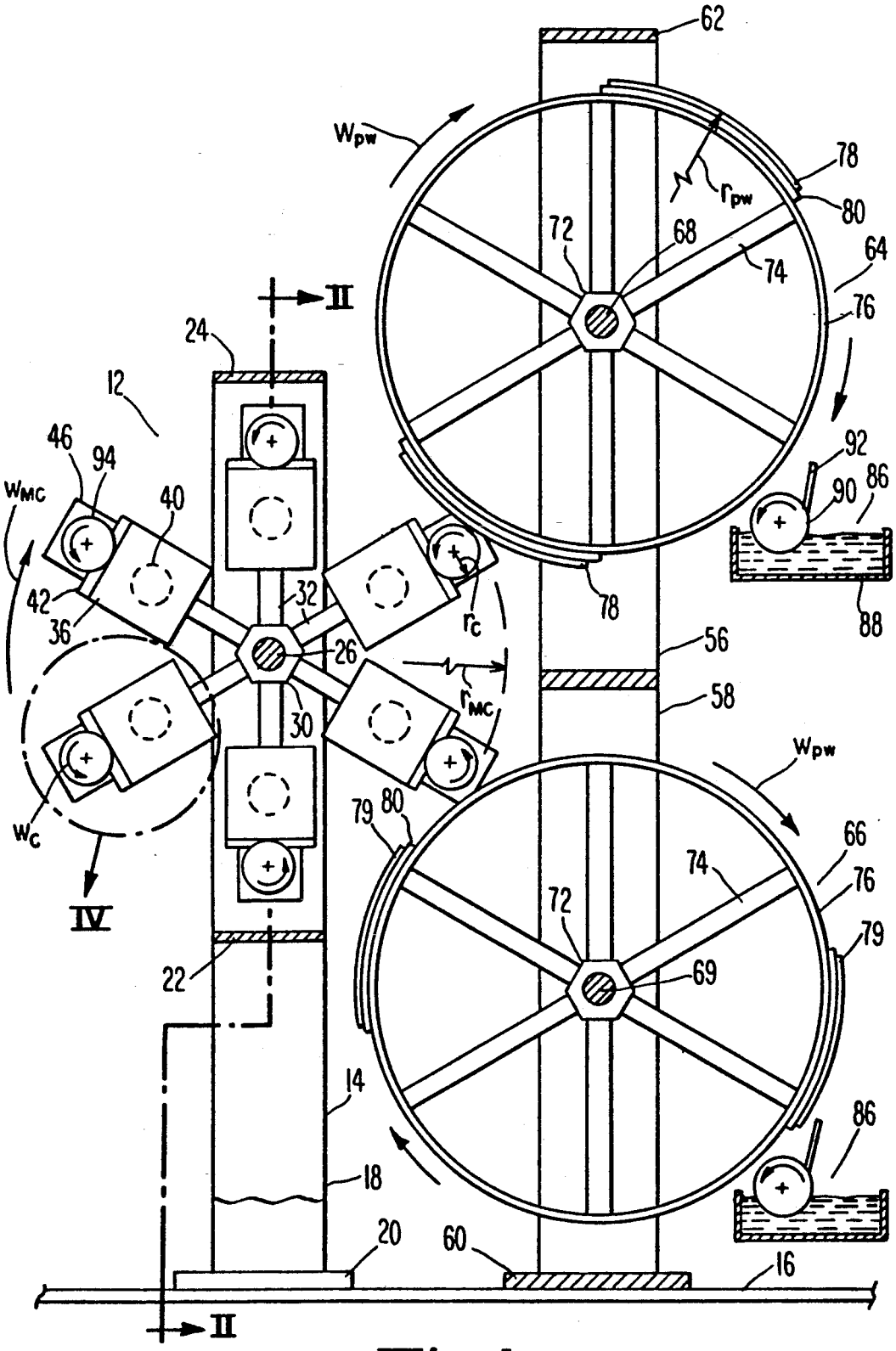
FIG. 1 is a elevation view, partially schematic, of a decorator according to the current invention.
Figure 2:
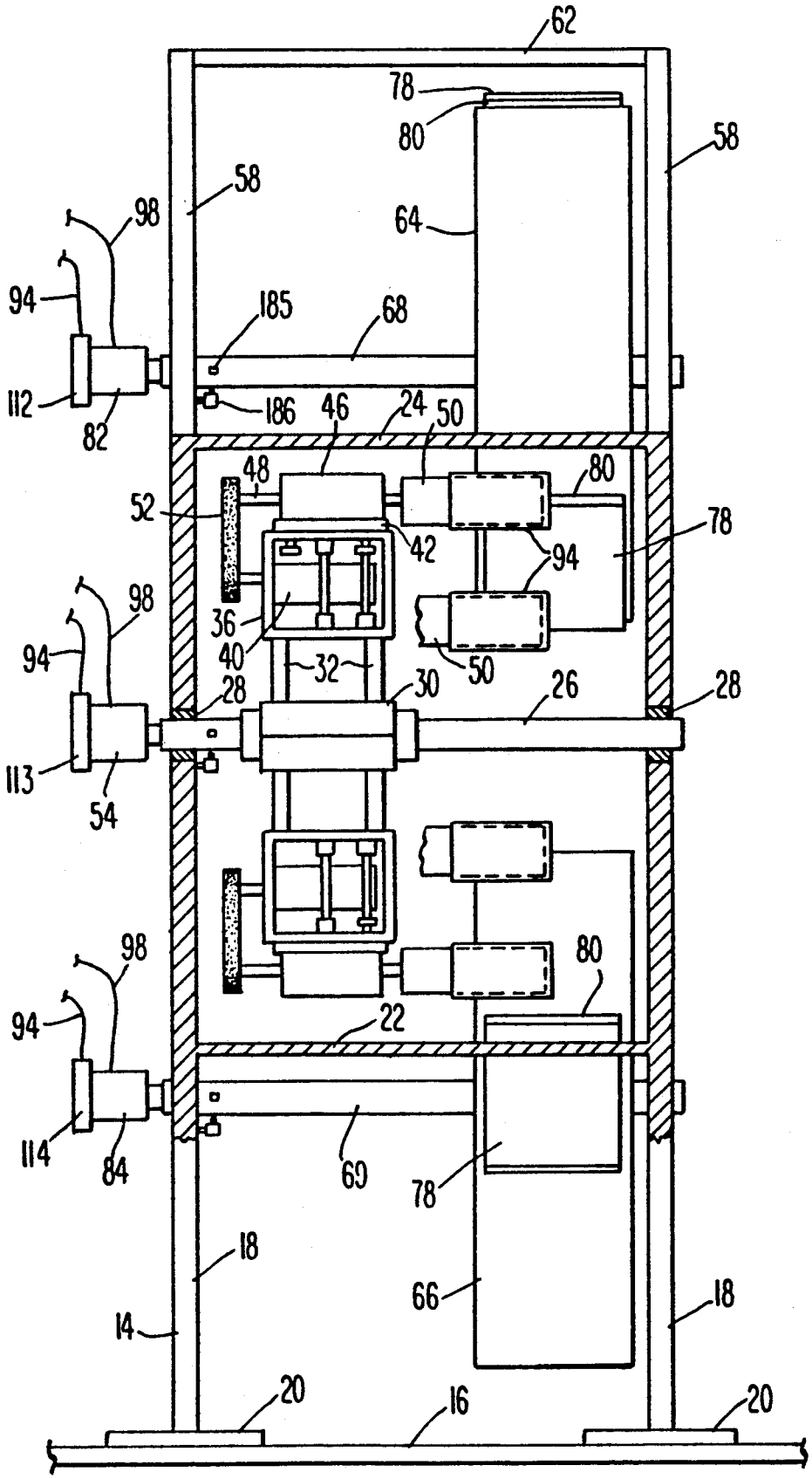
FIG. 2 is a vertical cross-section taken through line II—II shown in FIG. 1.

Referring now to the drawings in detail, reference is first made to FIGS. 1 and 2 wherein there is illustrated the details of a decorator 10 according to the current invention. The decorator 10 includes a mandrel cluster 12 and upper and lower printing plate wheels 64 and 66, respectively. As explained in detail below, cans 94 to be decorated are carried by the mandrel cluster 12 into sequential contact with printing plates 78 and 79 mounted on the plate wheels 64 and 66, respectively.

The upper and lower plate wheels 64 and 66 are supported on a stand 56 having a pair of uprights 58 carried by a base plate 60 and joined together at their tops by a cross brace 62. The plate wheels 64 and 66 include shafts 68 and 69, respectively, that are rotatably journalled in sleeves (not shown) carried by the upright 58. Electric motors 82 and 84 are attached to the shafts 68 and 69, respectively, of the upper and lower plate wheels 64 and 66. Encoders 112 and 114, which may be of the optical type, are mounted on the motors 82 and 84, respectively. As shown in FIG. 2, the motors 82 and 84 are coupled to the shafts 68 and 69 for direct drive. However, the motors could also drive the shaft indirectly via a timing belt or gearing. Each shaft 68 and 69 carries a hexagonal hub 72 having extending therefrom six radial spokes 74 that support a circular rim 76.

The rim 76 of each plate wheel 64 and 66 carries a pair of diametrically opposed flexographic printing plates 78 and 79, respectively, that are adjustably mounted on the rim 76 by means of a compliant mount 80. Each of the printing plates in each pair has the same image formed therein. That image constitutes the entire decoration to be applied to the can in a single color. Additional printing wheels carry other plates for decorating with additional colors may also be used. The image formed on the printing plates 78, 79 may comprise any graphical representation, including a background for other images, alphanumerics, depictions of objects or people, etc.

As shown in FIG. 1, each of the plate cylinders 64, 66 has associated therewith an inker 86. Each inker 86 includes a tray 88 in which ink is maintained at a prescribed level. An inker roll 90 is mounted for rotation within the tray 88 and has associated therewith a doctor blade 92. As the inker roll 90 rotates, it picks up ink from the tray 88, with the excess ink being doctored off by blade 92. From the roll 90, the ink is transferred to the printing plates 78 and 79 as they rotate past the inkers 86 so as to place the printing plates in rolling contact with the rolls 90. Each roll 90 is driven by an electric motor (not shown) controlled, by an electronic controller discussed below, so that its surface speed is equal to that of the printing plates 78 and 79.

The decorator also includes a mandrel cluster 12 having a support stand 24. The stand 14 has a base plate 16 and a pair of spaced uprights 18, each having a base plate 20. The uprights 18 are joined together by transverse members 22 and 24. The mandrel cluster 12 also has a shaft 26 which is suitably journalled in sleeves 28 carried by the uprights 18. The mandrel cluster 12 is driven by an electric motor 54 attached to one end of the shaft 26. An encoder 113, discussed further below, is mounted on the motor. As shown in FIG. 2, the motor 54 is coupled to the shaft 26 for direct drive. However, the motor 54 coul l also drive the shaft 26 indirectly via a timing belt or gearing. The shaft 26 has a hexagonal hub 30 from which six pairs of circumferentially spaced spokes 32 extend radially. Each pair of spokes 32 has a rectangular mandrel support frame 36 attached to its distal end, there being six support frames equally circumferentially spaced around the mandrel cluster 12.

Figure 5:
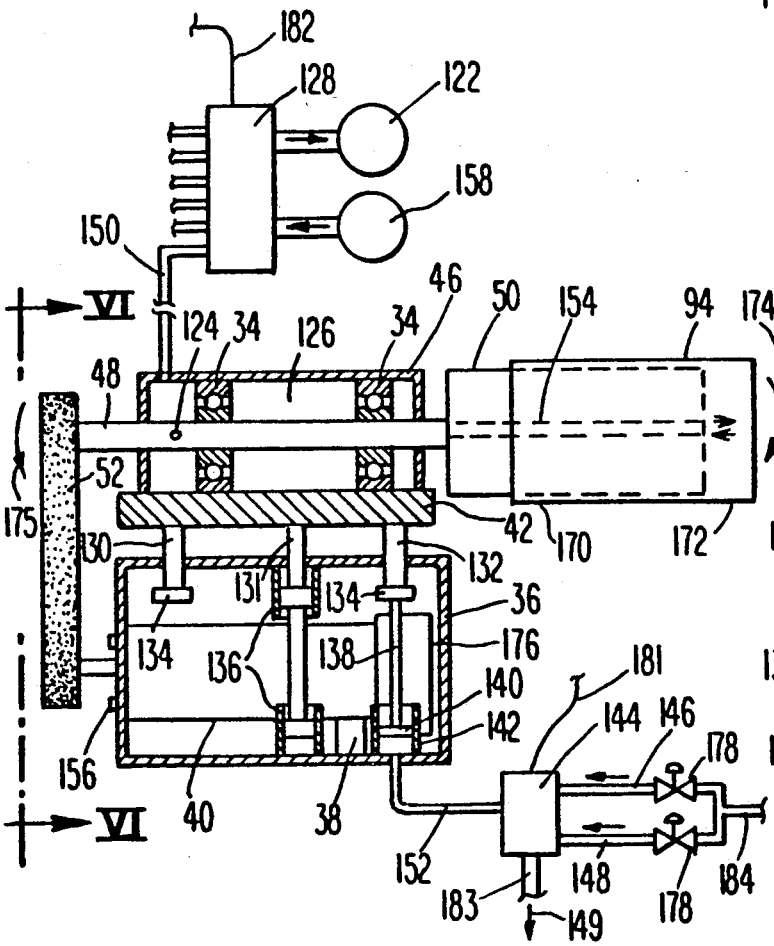
FIG. 5 is a cross-section through the line V—V shown in FIG. 4.
Figure 6:
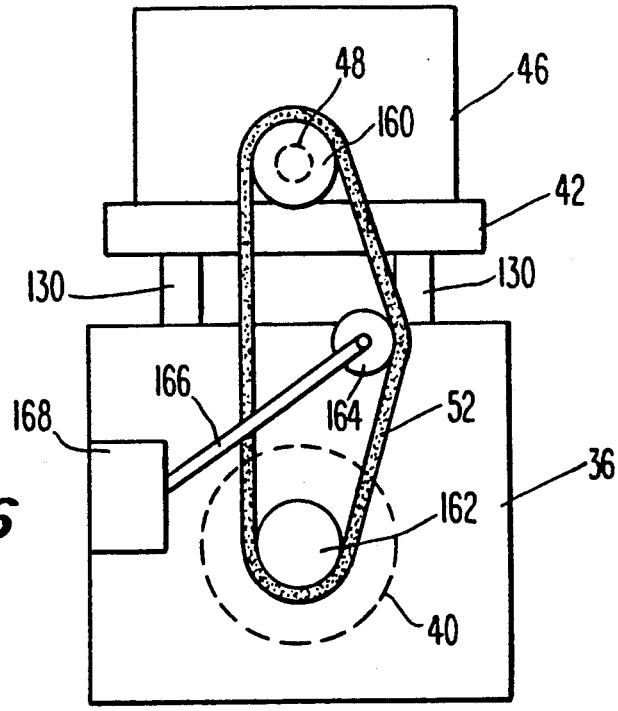
FIG. 6 is a view taken along line VI—VI shown in FIG. 5.

As shown in FIG. 5, an electric motor 40 is mounted, via screws 156 and a ball bushing mount 38, within each support frame 36. An encoder 176 is mounted on each mandrel motor 40. A mandrel support housing 46, mounted on a mounting plate 42, is slidably supported on each support frame 36 by three pairs of guide rods 130, 131 and 132, as explained further below. A mandrel shaft 48 is disposed through each support housing 46 and supported therein by bearings 34. As shown in FIG. 6, the mandrel shaft 48 has a sprocket 160 on one end that is driven by a flexible drive timing belt 52 driven by the motor 40 via sprocket 162.

As shown in FIG. 5, a mandrel 50 is attached to the end of the mandrel shaft 48 opposite the end driven by the timing belt 52. The outside diameter of the mandrels 50 is only slightly less than the inside diameter of the cans 94 so that the cans are stably supported on the mandrels, as shown in FIG. 2.

In operation, cans 94 to be decorated are loaded onto the mandrels 50, as shown in FIG. 2, while the mandrel cluster is rotating in a clockwise direction at a rotational speed $\omega_{mc}$, as indicated in FIG. 1. Methods for loading cans onto rotating mandrels are well known in the art — see, for example, U.S. Pat. No. 4,138,941 (McMillin et al.), hereby incorporated by reference in its entirety — and are not discussed further herein.

The cans 94 are held on the mandrels 50 by vacuum and ejected after decoration by pressurized air. As shown in FIG. 5, a vacuum source 122, which may be a vacuum pump, is connected, via a valve manifold 128 and tubing 150, to an air tight plenum 126 formed in each mandrel support housing 46. The mandrel shaft 48 is hollow and has a radial hole 124 which places an axial passage 154 in the mandrel 50 in air flow communication with the plenum 126. Thus, the vacuum source 122 draws air into the axial hole 154 in the mandrel 50, thereby applying a negative pressure that holds the can 94 onto the mandrel. A source of pressurized air 158, which may be a compressor, is also connected to the valve manifold 128 so that, by appropriate actuation of the valving in the manifold, pressurized air, rather than vacuum, is transmitted to the axial hole 154 in the mandrel 50, thereby causing the can 94 to be ejected from the mandrel.

Figure 4:
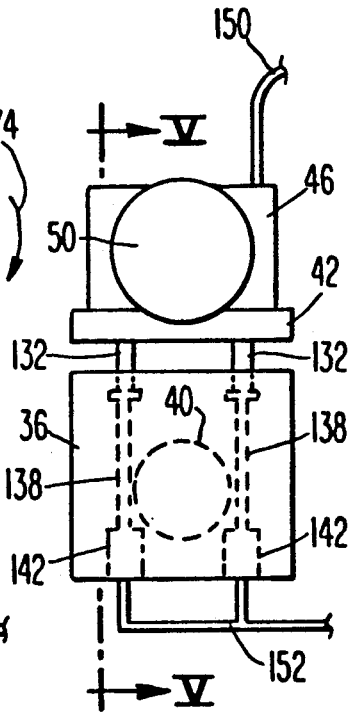
FIG. 4 is a detailed view of the portion of the decorator enclosed by the circle marked IV in FIG. 1.

In order to ensure uniform contact pressure by the printing plates 78 and 79 along the entire length of each can 94, the mandrels 50 must be rigidly supported. However, as explained further below, the mandrels 50 must also be free to move in the radial direction. Thus, according to the current invention, the mandrel support housing 46 is slidably supported on the support frame 36. Specifically, as shown in FIGS. 4 and 5, the mounting plate 42 on which the mandrel support housing 46 is mounted has three pairs of guide rods 130, 131 and 132 extending from its radially inward facing surface. These guide rods slide in close fitting holes in the support frame 36 so that the mandrels 50 are free to move substantially only in the radial direction, without undergoing significant tilting as a result of forces applied to the can 94 during printing. In addition, the center pair of guide rods 131 has collars formed thereon that slide within linear bearings 136 to provide additional rigidity. A collar 134 disposed at the distal end of each of the guide rod pairs 130 and 132 acts as a stop to limit the radial travel of the mandrel 50.

Notwithstanding the rigid sliding support arrangement discussed above, the contact between the can 94 and the printing plates 78 and 79 imposes a moment 174 that tends to rotate the mandrel 50 clockwise, as viewed in FIG. 5, so that it tilts inward. Such inward rotation would cause uneven printing since the contact pressure at the open end 170 of the can 94 would be greater than at the closed end 172. According to the current invention, this problem is solved by causing the mandrel timing belt drive 52 to impart a downward acting force on the mandrel shaft gear 160 shown in FIG. 6. This downward acting force creates a moment 175, shown in FIG. 5, that counteracts moment 174, thereby preventing the clockwise rotation of the mandrel. In the preferred embodiment, the downward acting force is created by an adjustable tensioner in conjunction with the drive chain 52. The adjustable tensioner is illustrated in simplified form in FIG. 6 and has a sprocket 164 attached to a rod 166 pivotally supported by an air cylinder 168. By adjusting the pressure within the air cylinder 168, the amount of tension in the timing belt drive 52, and therefore the amount of force pulling the sprocket 160 downward, can be varied so as to ensure that even contact pressure is achieved along the entire length of the can 94.

Figure 3:
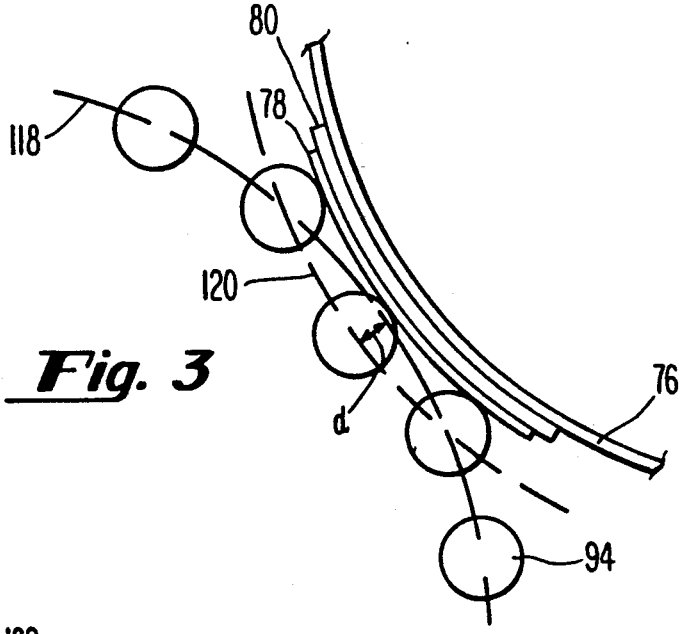
FIG. 3 is a schematic diagram showing the travel path of a can as it contacts a printing plate.

As shown in FIG. 3, if undisturbed, the mandrel cluster 12 would transport each can 94 so that it traveled in a circular path 118. As a result of contact with the printing plate 78, the can 94 must be displaced radially inward by an amount d so as to travel in the path 120. Thus, sufficient compliancy must be incorporated into the mandrel support system to allow for this radial displacement. Moreover, since the spring rate of the compliant support system determines the contact pressure of the cans against the printing plates, ideally, the spring rate should be adjustable so that the optimum pressure can be obtained.

According to the current invention, compliancy is obtained by providing the mandrels 50 with a pneumatic support system. As shown in FIGS. 4 and 5, a piston rod 138 having a piston 140 at its distal end is attached to each of the guide rods 132. Each piston 140 slides within a piston cylinder 142 supplied with either high pressure air 146 or low pressure air 148 from a valve manifold 144 via tubing 152 — it should be understood that the terms "high" and "low" pressure as used herein refer to the relative values of the pressure of the air 146 and 148. The valve manifold is capable of operation in at least two states. In the first state, the high pressure air 146 is supplied to the piston cylinder 142. In the second state, the low pressure air 148 is supplied to the piston cylinder. The valve manifold 144 is supplied with air from a pressurized air source, which may be the aforementioned source 158, via tubing 184. The pressure of the air 146 and 148 may be individually adjusted via pressure regulators 178.

Compliancy of the mandrel 50 support is achieved by translating the radial displacement d of the mandrel into reciprocal motion of the piston 140, thereby compressing the air supplied to the piston cylinder 142. The spring rate associated with this compliancy — that is, the amount of resisting force applied by the compressed air in response to a given displacement d — determines, in part, the magnitude of the contact pressure between the can 94 and the printing plates 78 and 79. According to the current invention, this spring rate can be readily adjusted by varying the pressure of the air 146 and 148 supplied to the cylinder 142 — for example, by using the pressure regulator 178 shown in FIG. 5.

As shown in FIG. 1, the plate wheels 64 and 66 are arranged vertically. Thus, gravity will cause a variation in the contact pressure between the upper and lower plate wheels. Specifically, when a can 94 is in contact with a printing plate 78 on the upper plate wheel 64, the combined weight of the can 94, mandrel 50, housing 46 and mounting plate 42 will subtract from the force generated in the piston cylinders 142 as a result of the deflection of the mandrels 50. As a result, the contact pressure of the can against the printing plate 78 is reduced. By contrast, when the can is in contact with a printing plate 79 on the lower plate wheel 66 this weight will add to the contact pressure. Thus, according to an important aspect of the current invention, the valve manifold 144 is supplied with both high pressure 146 and low pressure 148 air. The difference in pressure between air 146 and 148 is such that the effect of gravity on the radially outward force pressing the can into the printing plates is exactly offset.

In the preferred embodiment, the valving in the valve manifold 144 is automatically actuated by an electronic controller, discussed further below, so that high pressure air 146 is supplied to each mandrel support piston 140 prior to that mandrel moving into contact with the upper plate wheel 64. After each mandrel has contacted the upper plate wheel 64, the controller actuates the valve manifold 144 associated with that mandrel so that low pressure air 148 is supplied to its piston 140 prior to contact being made with the lower plate wheel 66. Thus, according to the current invention, uniform contact pressure is achieved with respect to printing by both the upper wheel printing plates 78 and the lower wheel printing plates 79 by varying the spring rate of the pneumatic support according to the circumferential position of mandrel.

For various reasons, it sometimes is advisable to avoid printing with respect to a particular mandrel 50 — for example, because it is detected that a can 94 was not mounted, or was improperly mounted, on that mandrel. According to the current invention, printing can be prevented with respect to each mandrel, on an individual basis, by retracting it radially inward so as to avoid contact with the printing plates. This is accomplished by using tubing 183 to connect a vacuum source, such as source 122, previously discussed, to the valve manifold 144 associated with each mandrel pneumatic support, as shown in FIG. 5. When it is determined that no printing should occur with respect to a particular mandrel 50, the aforementioned controller automatically actuates the valving in the valve manifold 144 for that mandrel so that the vacuum source is connected to its piston cylinder 142. As a result of air 149 being drawn out of the piston cylinder 142 by the vacuum source, the piston 140 is withdrawn, thereby retracting the mandrel support housing 46 so that the mandrel 50 does not contact the printing plates.

As shown in FIG. 1, rotation of the mandrel cluster 12 brings each of the cans 94 sequentially into contact with one of the plates 78 and 79 on each of the upper and lower plate wheels 64 and 68, respectively. As discussed further below, the rotational speed $\omega_c$ of the can 94 relative to its axis, as set by the mandrel motor 40, the rotational speed $\omega_{mc}$ of the mandrel cluster 12, as set by its motor 54, and the rotational speed $\omega_{pw}$ of the plate wheels 64 and 66, as set by their motors 82 and 84, are each closely synchronized so that the surface speed of the can 94 matches that of the plates 78 and 79, thereby causing the cans 94 to roll over the plates 78 and 79 without smearing. Accordingly, the speed of the mandrel cluster motor 54, the plate wheel motors 82 and 84, and each of the mandrel motors 40 are controlled so that $r_{pw}\omega_{pw}=r_c\omega_c+r_{mc}\omega_{mc}$, where $r_{pw}$, $r_c$ and $r_{mc}$ are the radii of the plate wheels 64 and 66, the cans 94 and the mandrel cluster 12, respectively, as shown in FIG. 1. As discussed below, according to the current invention, this synchronization is accomplished by an electronic controller.

In order to reduce the complexity of the calculations required to control the speed and registration of the various components, the diameter of the mandrel cluster 12 and the plate wheels 64 and 68 should be multiples of the diameter of the can 94. In the preferred embodiment, the diameter of the mandrel cluster is eight times the diameter of the cans 94, so that $r_{mc}=8\ r_c$. In addition, the diameters of the plate wheels 64 and 68 and the diameter of the mandrel cluster 12 are equal — that is, $r_{pw}=r_{mc}$. Thus, since there are six mandrels and two printing plates per plate wheel, $\omega_{pw}=3\ \omega_{mc}$.

In addition to the speed synchronization discussed above that is necessary to prevent smearing, the rotation of the plate wheels 64 and 66 must also be indexed to the mandrel cluster 12 so that when a can 94 is transported into position adjacent a plate wheel, one of the printing plates on the wheel is in position to initially contact the can at a predetermined location on the printing plate. In addition, for a given distance between the plate wheels 64 and 66, the proper relationship between the rotational speed of the mandrel cluster and the rotation speed of the cans must be maintained so that the can undergoes the proper number of revolutions in the time it takes for the can to travel from a printing plate 78 on the upper plate wheel 64 to a printing plate 79 on the lower plate wheel 66. This ensures that the image printed by a printing plate 79 on the lower plate wheel 66 is in registration with the image printed by a printing plate 78 on the upper plate wheel 64.

Figure 7:
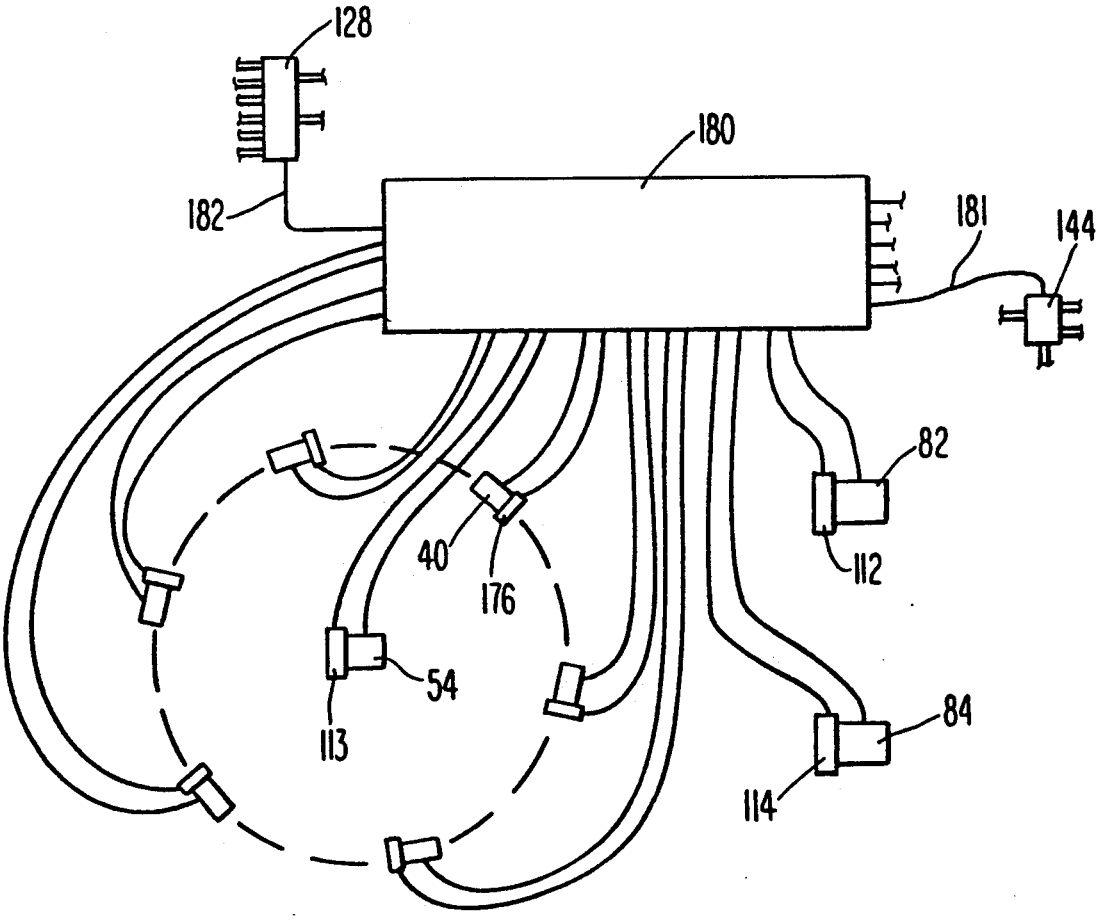
FIG. 7 is a schematic diagram of the control system for the decorator shown in FIGS. 1 and 2.

In the preferred embodiment, speed regulation and indexing are performed on a continuous basis by an electronic controller 180, shown in FIG. 7. In the preferred embodiment, the controller 180 is a microprocessor based multi-axis servo motion and logic controller programed for controlling the speed and shaft position of several motors. Such controllers, pre-programed so as to allow the user to develop application programing for controlling motor speed and position, as well as other functions, are commercially available from various suppliers — for example, the MAX/CONTROL model two axis motion controller supplied by Creonics, Inc., Lebanon, N.H., and the DMC-230 model three axis motor controller supplied by Galil Motion Control, Inc., Palo Alto, Calif. Since each plate wheel and mandrel motor is individually controlled, depending on the number of plate wheels and mandrels — that is, depending on the total number of motors to be controlled — a number of such controllers may be networked together to form the controller 180. Since, in the preferred embodiment, there are a total of nine motors to be controlled (i.e., one mandrel cluster motor, two plate wheel motors and six mandrel motors) two Creonics MAX/CONTROL and two Galil DMC-230 controllers are networked together.

As shown in FIG. 7, conductors connect the encoders 112, 113, 114 and 176, associated with each of the motors 54, 82, 84 and 176, to the controller 180, wherein the pulses from each encoder are accumulated, as discussed below. In addition, conductors connect the motors 54, 82, 84 and 176 to the controller 180, wherein signals are generated that, after suitable amplification by amplifiers (not shown), control the speed of each motor. Also, conductor 182 connects the controller 180 to the valve manifold 128 and conductors 181 connect the controller to the valve manifold 144 for each mandrel.

Figure 8:
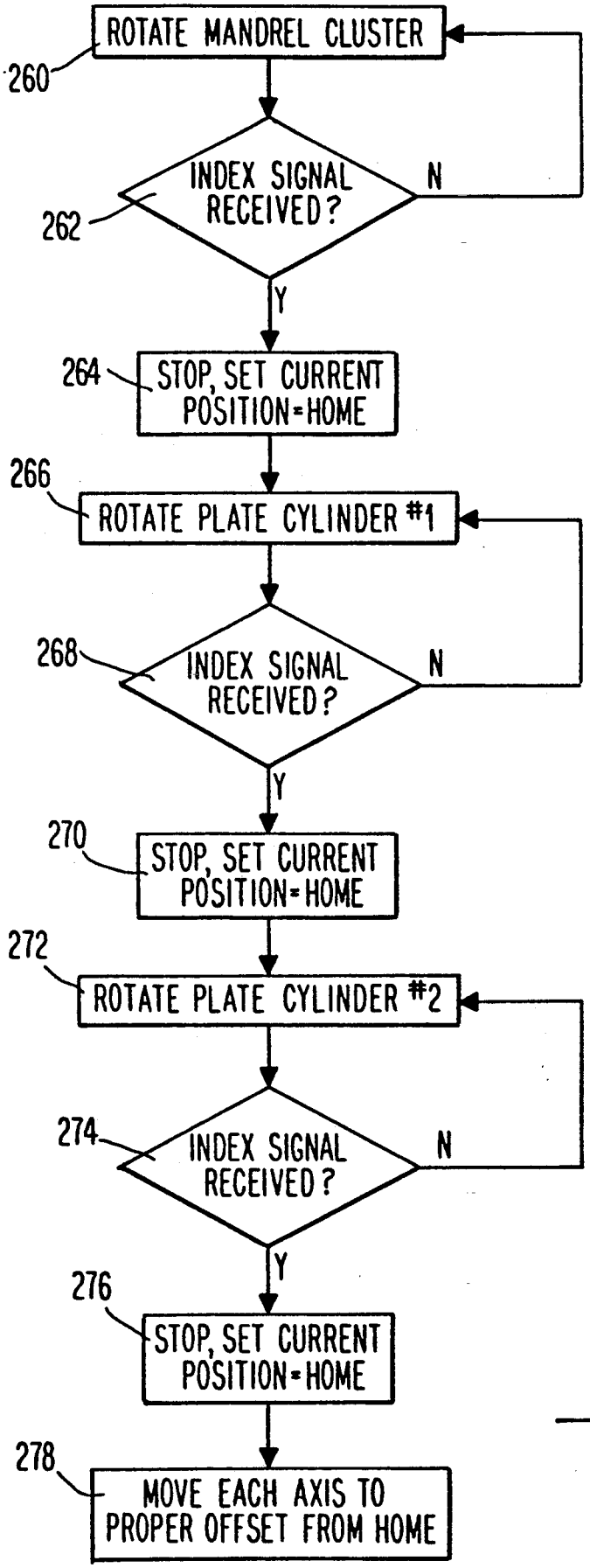
FIGS. 8–11 are a flow chart showing logic programed into the controller shown in FIG. 7.
Figure 9:
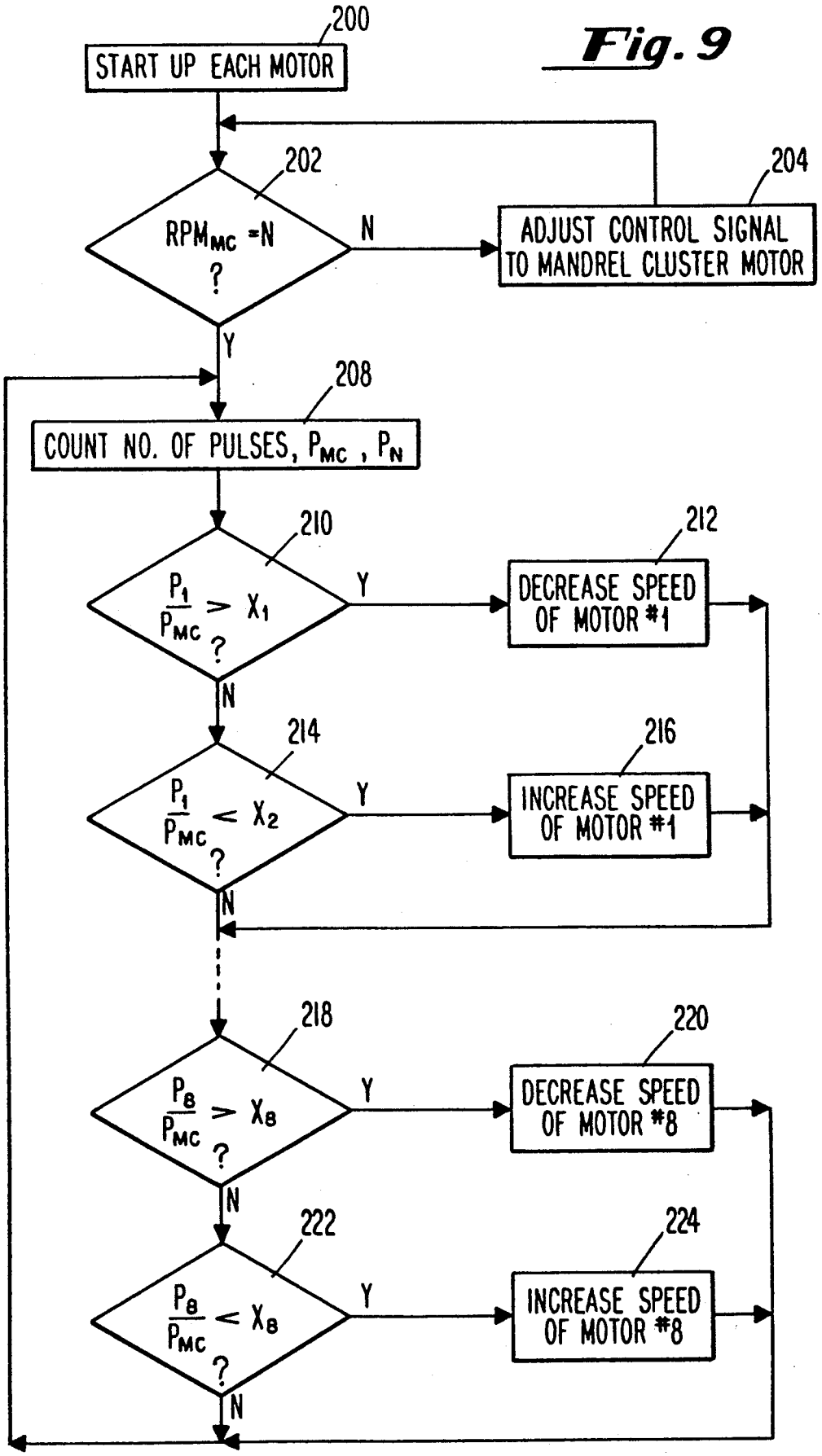

By way of illustration, a simplified logic diagram of one approach to synchronizing the speed and maintaining the registration of the mandrel cluster, plate wheels and mandrels is shown in FIGS. 8 and 9. Such logic can be readily programed, using techniques well known to those in the computer programing arts, into the controller 180. Appendices I and II, attached hereto, show the codes for the programs developed for the aforementioned Galil DMC-230 and Creonics MAX/CONTROL model electronic motor controllers, respectively, according to the current invention, using the commands provided for in the programing supplied with these controllers. As explained further below, in the preferred embodiment, the six mandrel motors 40 and the plate wheel motors 82 and 84 are slaved to the mandrel cluster motor 54. Thus, the program for the Galil DMC-230 model controllers shown in Appendix I controls the six mandrel motors 40 and the program for the Creonics MAX/CONTROL model controllers controls the plate wheel motors 82 and 84 and the mandrel cluster motor 54, as well as other logic functions, such as the actuation of the valves in the valve manifolds 128 and 144.

Referring to FIG. 8, in steps 260–278, the "home" position for the mandrel cluster and each plate cylinder is set when an index signal is received. The index signal may be a once per encoder revolution pulse on a separate encoder output, with the encoder having been coupled to its respective drive shaft so that the pulse is generated at a predetermined circumferential orientation of the component — for example, for the mandrel cluster encoder 113, the index point might be when a particular mandrel was at 12 o'clock, for the upper plate wheel encoder 112, the index point might be when the leading edge of one of the printing plate 78 was at 6 o'clock, etc. Alternatively, encoders generating uniform pulses may be used and limit switches 186, the output from which is connected to the controller 180, installed on each component so that a switch is tripped at a predetermined orientation of each component by a "dog" 185, as shown in FIG. 2. In either case, the controller 180 would be programed to ignore index signals after the first signal for each component so that, after initializing, the pulses are continuously accumulated so long as the components continue to rotate.

In order to obtain greater accuracy with respect to the index location, the controller 180 may be programed with logic (not shown) that adjusts the pulse count at initialization by a predetermined amount — for example, if it was desired to generate the index signal for the upper plate wheel 64 when the leading edge of one of the printing plates reached precisely the 6 o'clock position but, because of inaccuracies in positioning, the index signal generator, whether a pulse from the encoder or a limit switch, produced a signal prematurely, the controller 180 would be programed to initially subtract a predetermined number of pulses from the pulse count after initialization. This approach also allows the registration to be adjusted "on the fly."

Referring to FIG. 9, in step 200, each of the motors 54, 82, 84 and 40 is started and manually brought up to their approximate design operating speed by the controller 180. Next, in steps 202 and 204, the controller 180, which determines the speed of the mandrel cluster motor 54 by measuring the frequency of the output pulses from the mandrel cluster motor encoder 113, regulates the output signal to the mandrel cluster motor 54 until the predetermined optimum operating speed for the mandrel cluster motor is attained. In the preferred embodiment, the operating speed of the mandrel cluster 12 is approximately 400 RPM.

In step 208, the pulse count accumulated for each component is sensed, the pulse count for the mandrel cluster 12 being identified as $P_{mc}$ and the pulse count each of the remaining eight components — that is, the two plate wheels and the six mandrels — being identified as $P_1 \ldots P_8$.

In the preferred embodiment, the controller 180 slaves the mandrel motors 40 and the plate wheel motors 82 and 84 to the rotation of the mandrel cluster motor 54. If the components are properly synchronized and maintained in the correct registration, a predetermined relationship — that is, a certain ratio X — will be maintained between the cumulative pulse count from the mandrel cluster motor encoder 113 and the cumulative pulse counts from the encoders 176, 112 and 114 associated with the mandrel and plate wheel motors 40, 82 and 84, respectively. Thus, in steps 210 to 224, after each pulse count, the controller 180 compares the ratio of the pulse counts from each mandrel and plate wheel motor encoder with respect to the pulse count from the mandrel cluster motor encoder 113 to the predetermined ratios $X_1 \ldots X_8$ that will result in synchronization and registration. If the ratio associated with any of the slaved motors deviates from the predetermined quantity, the controller 180 generates a signal which increases or decreases the speed of that motor accordingly until the correct ratio of the cumulative pulse counts is obtained. Alternatively, once the components have been indexed so that proper registration is obtained, the controller 180 can be programed with logic to control each motor to a predetermined speed which is known to maintain registration. Such open loop control is possible because of the inherent accuracy of the controller and encoders.

Figure 10:
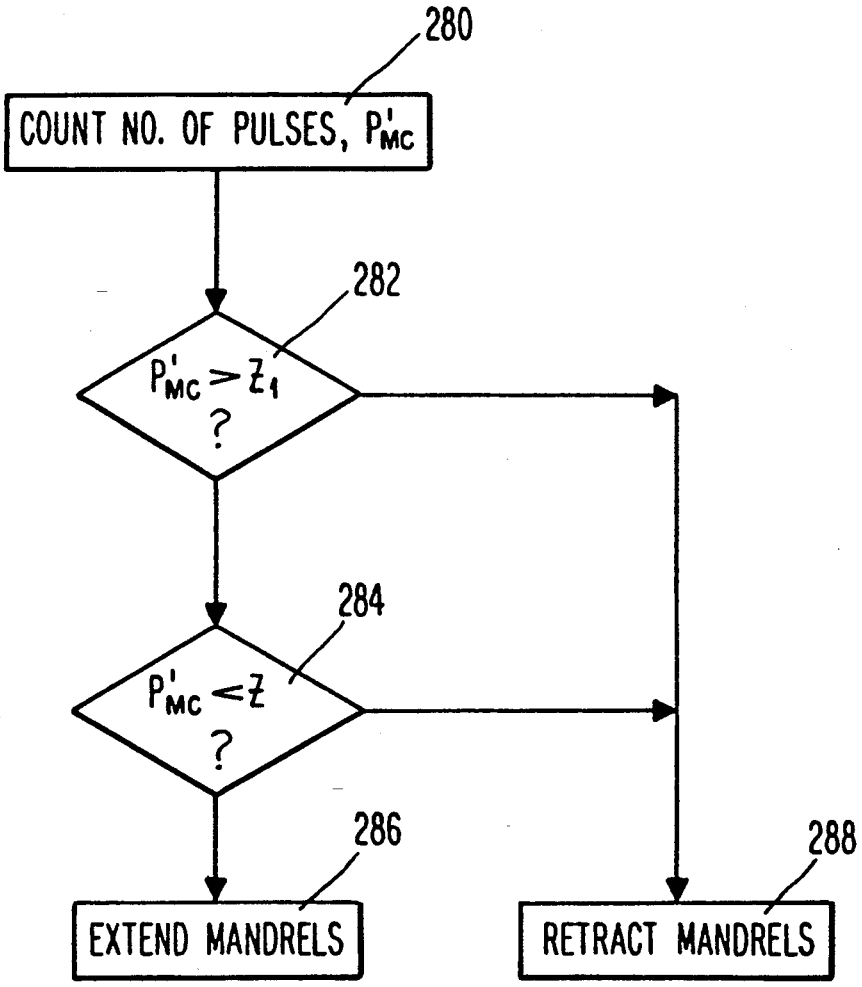

As previously discussed, the controller 180 is also programed with logic to actuate the valve manifold 144 associated with each mandrel 50 so that pressure is supplied to the pistons 140 to retract or extend the mandrels during the appropriate position intervals. Logic for performing this function is shown in FIG. 10. In step 280, the pulses from the encoder 113 are accumulated during each revolution of the mandrel cluster 12. In steps 282 and 284, the controller compares the pulse count to predetermined quantities and generates signals to actuate the various valve manifolds 144 accordingly in steps 286 and 288.

Figure 11:
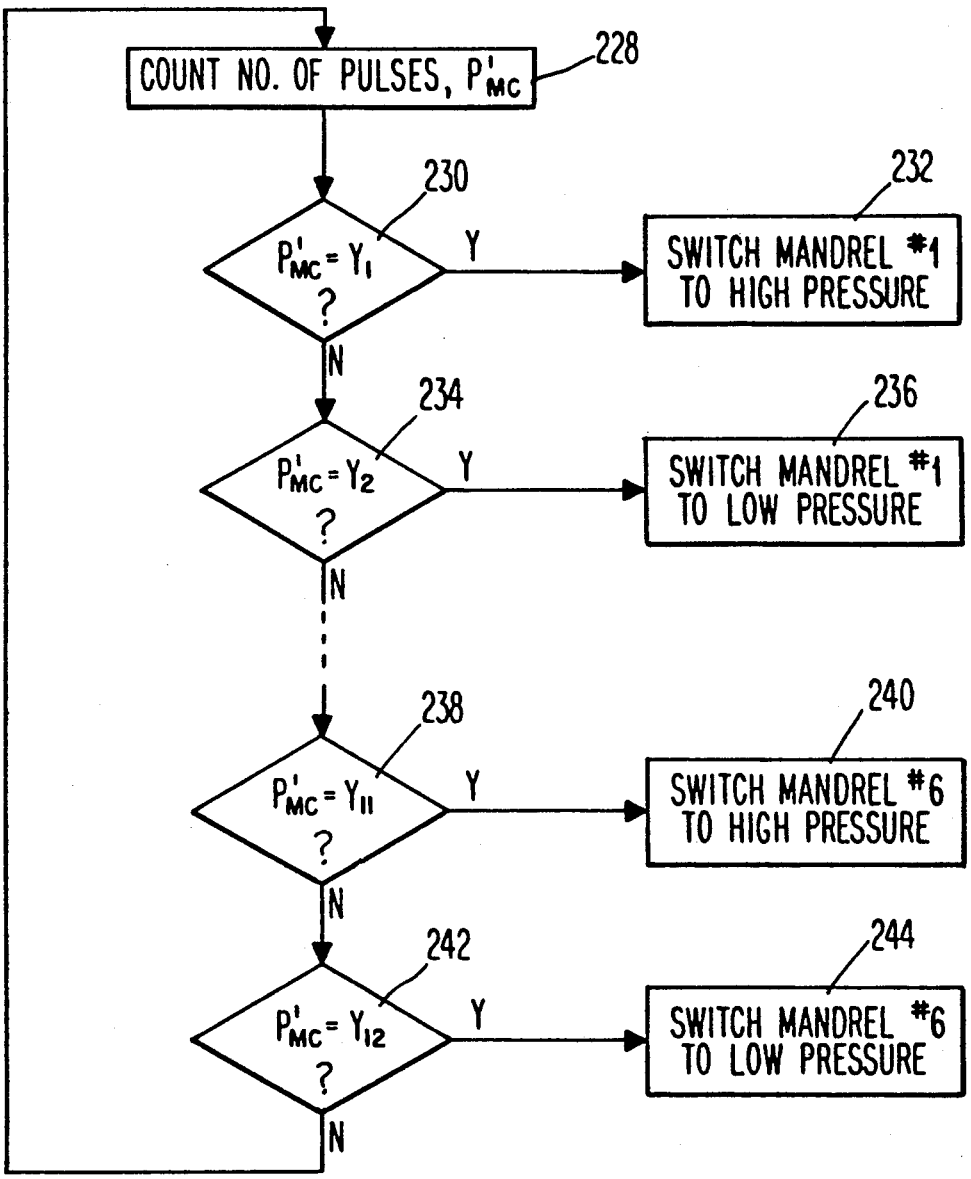
Figure 12:
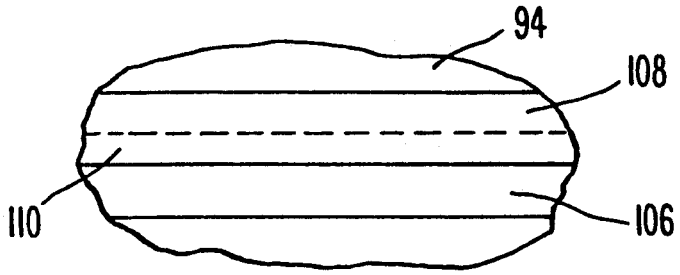
FIG. 12 is a schematic plan view showing how a second flexographic ink may be applied over a first flexographic ink with the overprinting inks providing a third color.

As previously discussed, the controller 180 is also programed with logic to actuate the valve manifold 144 associated with each mandrel 50 so that the pressure of the air supplied to the pistons 140 alternates from high to low pressure as the mandrels rotates into position to contact the upper and lower plate wheels, respectively. Logic for performing this function is shown in FIG. 11. In step 228, the pulses from the encoder 113 are accumulated during each revolution of the mandrel cluster 12. In steps 230 to 244, the controller compares the pulse count to predetermined quantities that are indicative of the circumferential position of each mandrel and generates signals to actuate the various valve manifolds 144 accordingly — for example, a pulse count of $Y_1$ indicates that mandrel no. 1 will shortly contact one of the printing plates 78 on the upper print wheel 64, hence, when such a pulse count is reached, the controller 180 generates a signal to actuate the valve manifold 144 associated with mandrel no. 1 so that low pressure air 148 is supplied to the piston 140 of mandrel no. 1. Similar logic allows vacuum or pressure to be applied to each mandrel as cans are loaded or unloaded, respectively.

The process by which the can bodies 94 is decorated is called "dry trap printing" whereby the can surface is printed with a first quick dry ink, followed by the application of a second ink to the dried first ink surface. This "dry trap" process allows overprinting of transparent inks thereby forming a third color. This is not achievable with the blanket applied paste inks heretofore used in can decorating. Thus, in FIG. 11 there is illustrated a portion of a can body 94 to which a first ink stripe 106 is applied followed by the application of a second ink stripe 108 so that the two ink stripes overlap in portion 110. The ink in the overlapping portion 110 will be overprint to blend the colors of the two inks of the stripes 106 and 108.

While only two plate cylinders 64 and 66 have been illustrated, it is to be understood that additional plate cylinders may be utilized. This would require that the axis of the plate cylinders be relocated.

Although only a preferred embodiment of the decorator has been specifically illustrated and described herein, it is to be understood that the invention may embody other specific forms without departing from the spirit and scope of the invention as defined by the appended claims.

LIST OF REFERENCE NUMERALS

10 Decorator
12 Mandrel cluster
14 Mandrel support stand
16 Mandrel support stand base plate
18 Mandrel support stand uprights
20 Base plate for upright
22, 24 Transverse members
26 Mandrel cluster shaft
28 Mandrel cluster sleeve
30 Mandrel cluster hub
32 Mandrel spoke
34 Mandrel mounting plate
36 Mandrel motor mounting plate
38 Mandrel motor ball bushing mount
40 Mandrel motor
42 Mounting plate
44 Mandrel base plate
46 Mandrel housing
48 Mandrel shaft
50 Mandrel
52 Mandrel drive connection
53 Mandrel cluster motor
56 Plate cylinder stand
58 Plate cylinder upright
60 Base plate for upright
62 Plate cylinder stand cross brace
64, 66 Plate cylinders
68 Plate cylinders shaft
70 Plate cylinders shaft sleeve
72 Plate cylinders shaft hub
74 Plate cylinders spoke
76 Plate cylinders rim
78 Printing plate
80 Printing plate mount
82 Upper plate cylinder motor
84 Lower plate cylinder motor
86 Inker
88 Inker tray
90 Inker roll
92 Inker doctor blade
94 Can
106, 108 Ink stripes
110 Overlapping portion of ink stripes
112–114 Encoders
118 Undisturbed can path
120 Actual can path during contact
122 Vacuum source
124 Hole in mandrel shaft
126 Mandrel housing plenum
128 Vacuum manifold
130–132 Guide rods
134 Stop
136 Linear bearing
138 Piston shaft
140 Piston
142 Piston cylinder
144 Air pressure manifold
146 High pressure air
148 Low pressure air
150, 152 Tubing
154 Hole in mandrel
156 Screws
158 Pressure source
160, 162 Sprockets
164 Idler sprocket
166 Lever
168 Air cylinder
170 Open end of can
172 Closed end of can
174, 175 Moments
176 Mandrel motor encoders
178 Pressure regulator
180 Electronic controller
181, 182 Conductors
183, 184 Tubing
185 Dog
186 Switch
200–284 Logic steps

BEST AVAILABLE COPY

Appendix I - Code for Galil DMC-230 Model Controller

```
000 NO #A RUNS MANDRELS AT 10 PCNT
001 #A
002 DC
003 SH
004 JG -12800,-12800,-12800
005 BG
006 EN
007 NO #B RUNS MANDRELS AT 25 PCNT
008 #B
009 DC
010 SH
011 JG -32000,-32000,-32000
012 BG
013 EN
014 NO #C RUNS MANDRELS AT 50 PCNT
015 #C
016 DC
017 SH
018 JG -64000,-64000,-64000
019 BG
020 EN
021 NO #D RUNS MANDRELS AT 18 PCENT
022 #D
023 DC
024 SH
025 JG -23040,-23040,-23040
026 BG
027 EN
```

Appendix II - Code for Creonics MAX/CONTROL Model Controller

```
OPT [ECAM]
\
FORM [X-XX.XXXX,"REV",Y-XX.XXXX,"REV"]
\
\COMM[A-9600,B-9600,MULTIDROP]
COMM[A-9600,B-2400] \MULTIDROP MODE BUGGY
\
AXIS [X-SERVO,LINEAR,Y-SERVO,LINEAR]
\
DEF V0[F-XX.XXX,P="GEAR RATIO",U-3.0,L-0.1]
\
DEF V1[F-XXX,P="JOG VELOCITY%",U-200,L-1]
\
DEF V2[F-XX.XX,P="INKER ENGAGE POSITION",U-10.0,L-0.0]
\
DEF V3[F-XX.XX,P="MANDREL ENGAGE POSIT",U-10.0,L-0.0]
\
DEF V4[F-XX.XX,P="INKER DISENGAGE POSIT",U-10.0,L-0.0]
DEF V5[F-X.XXXX,P="CAN WHEEL OFFSET",U-1.0,L-0.0]
\
DEF V6[F-X.XXXX,P="PLATE WHEEL 1 OFFSET",U-1.0,L-0.0]
\
DEF V7[F-XX,P="CAN UNLOAD SPEED%",U-10,L-1]
\
DEF V8[F-XX,P="CAN LOAD SPEED%",U-10,L-1]
\
DEF V9[F-XX,P="MANDREL EXTENSION CODE",U-63,L-0]
\
DEF V10[F-X.XXXX,P="PLATE WHEEL 2 OFFSET",U-1.0,L-0.0]
\

WIDTH 79
\
\DISP [VPX=" CW pos ",VPY=" PW1 pos "]
DISP [VPX=" CW pos ",VEX=" CW err ",VEY=" PW1 err "]
\
\
END HEADER
\
\******************** menu loop
*****************************
```

```
$5
DB20,0 \DISABLE RUNTIME DISPLAY WHILE PRINTING
P"          DECO II CONTROL PROGRAM"
P" "
P"   PLEASE ENTER YOUR SELECTION"
P" "
P"          A. HOME CAN WHEEL"
P"          B. HOME PLATE WHEEL 1"
P"          C. HOME PLATE WHEEL 2"
P"          D. PASSIVELY HOME CAN WH AND PLATE WH-1"
P"          E. CLEAN PLATE WHEELS"
P"          F. DECORATE CANS"
P"          G. X Y FEEDBACK OFF"
P"          H. MOVE WHEELS TO ZERO"
P"          I. LOAD CANS"
P"          J. UNLOAD CANS"
P"          X. HIGH SPEED DRY DEMO"
P"          Q. EXIT FROM THIS PROGRAM"

P" "
```

BEST AVAILABLE COPY

```
P"   SELECTION > "
?K1
?(VK="A"),>10
?(VK="B"),>20
?(VK="C"),>30
?(VK="D"),>40
?(VK="E"),>50
?(VK="F"),>60
?(VK="G"),>70
?(VK="H"),>71
?(VK="I"),>72
?(VK="J"),>73
?(VK="X"),>74
?(VK="Q"),>80
>5
$10  \ *****HOME THE CAN WHEEL***** H COMMAND BUGGY???
EX0
P"HOMING CAN WHEEL"
P"PLACE MANDREL 1 UP AND PLATE WHEEL OUT OF WAY"
P"HIT ANY KEY WHEN READY"
?K1
DB20,1 \TURN RUNTIME DISPLAY ON
EX1
HX
?HX0
MIX+V5,/10,\10 \MOVE X PROPER OFFSET
?SX0 \WAIT UNTIL X FINISHED MOVING
NX+0.0
MX-0.02,/10,\10 \MOVE BY OFFSET TO GIVE MANDREL CLEARANCE
?SX0 \WAIT UNTIL STOPPED
DB20,0 \TURN RUNTIME DISPLAY OFF
P"DONE"
>5
$20  \ ******* HOME PLATE WHEEL 1***** H COMMAND BUGGY???
EY0
P"HOMING PLATE WHEEL 1"
P"PLACE PLATE 0 DOWN AND CAN WHEEL OUT OF WAY"
P"HIT ANY KEY WHEN READY"
?K1
DB20,1 \TURN RUNTIME DISPLAY ON
EY1
HY
?HY0
MIY+V6,/10,\10 \MOVE Y PROPER OFFSET
?SY0 \WAIT UNTIL Y FINISHED MOVING
NY+0.0 \DEFINE THIS POSITION TO BE 0
```

```
MY-.06,/10,\10 \MOVE Y BY OFFSET TO GIVE MANDREL CLEARANCE
?SY0 \WAIT UNTIL STOPEED
DB20,0 \TURN RUNTIME DISPLAY OFF
P"DONE"
>5
$30   \ HOME PLATE WHEEL 2
~B,P"EX0"
P"HOMING PLATE WHEEL 2"
P"PLACE PLATE 0 DOWN AND CAN WHEEL OUT OF WAY"
P"HIT ANY KEY WHEN READY"
?K1
~B,P"EX1"
~B,P"HX"
P"HOMING PW2"
P"HIT ANY KEY WHEN PW2 MOTION STOPS"
?K1
~B,P"MIX+V6,/10,\10" \MOVE PW2 PROPER OFFSET
P"EXECUTING PW2 OFFSET"
P"HIT ANY KEY WHEN PW2 MOTION STOPS AGAIN"
?K1
~B,P"NX+0.0" \DEFINE THIS POSITION TO BE 0
P"DONE"
>5
\********** PASSIVE HOMING ROUTINE **********************
$40   \ HOME THE CAN WHEEL AND PLATE WHEEL 1 TO THE START
PRINT POSITION
P"HOMING CAN WHEEL AND PLATE WHEEL PASSIVELY"
P"PLACE MANDREL 1 UP AND PLATE 0 DOWN"
P"HIT ANY KEY WHEN READY"
EX0
EY0
?K1
DB20,1 \TURN RUNTIME DISPLAY ON
~B,P"O1,1"   \ RETRACT THE CAN MANDRELS
HPX
P"MOVE CAN WHEEL SLOWLY TOWARD HOME"
?HX0
P"FOUND HOME MARKER FOR CAN WHEEL"
P"HIT ANY KEY TO CONTINUE"
P"HOMED XPOS=",VPX
?K1
EX1
MX+V5,/10,\10 \MOVE X PROPER OFFSET
?SX0 \WAIT FOR X MOTION TO STOP
P"POST-OFFSET XPOS=",VPX
NX+0.0 \DEFINE THIS X POSITION TO BE 0
P"NOW MOVE PLATE WHEEL SLOWLY TO HOME"
HPY
?HY0
P"FOUND PLATE WHEEL HOME MARKER"
P"HIT ANY KEY TO CONTINUE"
?K1
EY1
MY+V6,/10,\10  \MOVE Y PROPER OFFSET
?SY0 \WAIT FOR Y MOTION TO STOP
NY+0.0 \DEFINE THIS Y POSITION TO BE 0
MY-0.06,/10,\10 \MOVE WHEELS TO OFFSET SO THAT MANDRELS
```

```
MX-0.02,/10,\10 \DONT HIT PLATE WHEN SPINNING, ALSO MAINTAIN
3>1 RATIO
?SX0
?SY0 \WAIT UNTIL EVERYBODY DONE MOVING AGAIN
DB20,0 \TURN RUNTIME DISPLAY OFF
P"DONE HOMING, RELEASING MANDRELS"
~B,P"O1,0"   \ RELEASE THE CAN MANDRELS
>5
$50   \ PLATE WHEEL CLEANING ROUTINE
P"CLEANING PLATE WHEEL"
P"WHEELS WILL MOVE IN THIS PROCEDURE"
P"HIT ANY KEY WHEN READY"
?K1 \WAIT FOR KEYHIT
EY1
EX1
~B,P"O1,1" \RETRACT MANDRELS
MX-0.02,@50,/10,\10
MY+.25,@50,/50,\50 \MOVE PLATE WHEEL 1 TO CLEANING POSITION
?SY0 \WAIT UNTIL STOPPED
~B,P"O1,0" \TURN MANDREL RETRACT OFF
P"HIT ANY KEY WHEN DONE CLEANING"
?K1 \WAIT FOR KEYPRESS
~B,P"O1,1" \TURN MANDREL RETRACT BACK ON
MY-0.06,@50,/50,\50 \MOVE PLATE WHEEL 1 BACK TO ZERO
?SY0 \WAIT UNTIL STOPPED
~B,P"O1,0" \TURN MANDREL RETRACT OFF
P"DONE"
\C0,5
\?C0,1
>5
$60
\*******************PRINT CANS *******************
\
\
P"PRINTING CANS"
~B,P"O0,0"
~B,P"O1,0"
~B,P"O2,0"
~B,P"O4,0" \INITIALIZE AUX OUTPUT STATES
~B,P"O5,0"
(O[0,8]=0)
(O[8,4]=0) \INITIALIZE ONBOARD OUTPUTS STATES
.E1 \PROMPT FOR SPEED
.E2 \PROMPT FOR INKER ENGAGE POSIT
.E3 \PROMPT FOR MANDREL ENGAGE POSIT
.E4 \PROMPT FOR INKER DISENGAGE POSIT
P"RETRACT MANDRELS AND SETUP GEARING"
~B,P"O1,1"      \RETRACT THE MANDRELS
~B,P"O0,1"      \AND TURN ON MANDREL SUCK
EX1
EY1
~B,P"EX1" \ENABLE ALL AXES MOTION
GYXC+,3         \ GEAR Y TO X COMMAND 3 TO 1 RATIO
~B,P"GXY+,3"     \ FOR PW2 ALSO
P"START BOTH WHEELS JOGGING"
JX+,@V1,/30,\30 \ RUN CAN WHEEL AT SPECIFIED PRECENTAGE SPEED
\JY+,@V1,/75,\75 \RUN PLATE WHEEL AT 3X CAN WHEEL
DB20,1 \ENABLE STATUS DISPLAY
WX+V2
```

BEST AVAILABLE COPY

BEST AVAILABLE COPY

```
?PX0 \SET AND WAIT FOR WATCH POINT IN V2
~B,P"O4,1" \TURN UP INKER SPEED
~B,P"O2,1" \PUSH INKER FORWARD
~B,P"O5,1" \2ND INKER TOO
WX+V3
?PX0 \WAIT FOR SETPOINT IN V3, DELAY LETS PLATE BE PRE-INKED
ONCE
~B,P"O1,0" \TURN OFF MANDREL RETRACT VACUUM NOW
(O[6,6]=V9) \TURN ON LOW PRESSURE FOR CODED MANDRELS NOW
WX+V4
?PX0 \SET AND WAIT FOR ANOTHER WATCH POINT, IN V4
~B,P"O2,0" \PULL INKER BACK FROM PLATES
~B,P"O5,0" \OTHER INKER TOO
~B,P"O4,0" \DECEL INKER SPEED
(O[6,6]=0) \TURN OFF MANDREL PRESSURE
~B,P"O1,1" \TURN ON MANDREL RETRACT VACUUM
JX0 \STOP JOGGING X,Y
?SY0
?SX0                \WAIT FOR ALL MOTION TO STOP
GYXC0               \ TURN OFF GEARING
~B,P"GXY0"     \DISABLE GEARING ON REMOTE AXIS TOO
MY-0.06,@99
MX-0.02,@50 \REWIND WHEELS TO PARKING POSITION, SAME AS IN
HOMING ROUTINE
~B,P"MX0,@50"
?SX0                \WAIT FOR ALL MOTION TO STOP
?SY0
~B,P"O1,0" \ALL DONE, TURN OFF MANDREL RETRACT VACUUM
~B,P"O0,0" \ALSO TURN OFF MANDREL SUCK
DB20,0 \TURN RUNTIME DISPLAY OFF
P"DONE"
>5 \GO BACK TO MAIN MENU
$70  \ TURN OFF X AND Y FEEDBACK
P"DISABLING CAN WHEEL AND PW1 MOTION"
EX0
EY0
P"DONE"
>5
$71
\ ****** MOVE PRINTER WHEELS TO ZERO ******
P"MOVING WHEELS TO ZERO"
~B,P"01,1" \RETRACT MANDRELS
EX1
EY1
MX-.02,@50,/25,\25
MY-.06,@99,/75,\75
?SX0
?SY0 \WAIT FOR MOTION TO FINISH
~B,P"01,0" \ RELEASE MANDRELS
P"DONE"
>5 \ GO BACK TO MAIN MENU
$72
\ ****** LOAD CANS TO MANDRELS
P"LOADING CANS TO MANDRELS"
```

BEST AVAILABLE COPY

```
P"HIT ANY KEY WHEN READY TO LOAD"
?K1
EX1
~B,P"O0,1" \TURN MANDREL SUCK ON
~B,P"O1,1" \RETRACT MANDRELS
JX-,@V8,/10,\10
P"HIT ANY KEY AGAIN WHEN DONE LOADING"
?K1
JX0
?SX0 \WAIT TIL COMPLETELY STOPPED
MX-.02,@25,/50,\50 \MOVE CAN WHEEL BACK TO ZERO
?SX0 \WAIT TIL MOVE DONE
~B,P"O0,0" \SHUT OFF MANDREL SUCK
~B,P"O1,0" \RELEASE MANDRELS
P"DONE"
>5 \GO BACK TO MAIN MENU
$73
\************* UNLOAD CANS FROM MANDRELS ***********
P"UNLOADING CANS FROM MANDRELS"
~B,P"O0,0" \MAKE SURE SUCK IS OFF
~B,P"O1,1" \RETRACT MANDRELS
EX1
JX+,@V7,/10,\10
P"HIT ANY KEY WHEN DONE"
?K1
JX0 \STOP MOTION
?SX0 \WAIT TIL MOVE DONE
MX-.02,@25,/10,\10 \REWIND CAN WHEEL
?SX0 \WAIT TIL MOVE DONE
~B,P"O1,0" \RELEASE MANDRELS
P"DONE"
>5 \GO BACK TO MAIN MENU
$74
\*******************HIGH SPEED DRY DEMO *******************
\
\
P"HIGH SPEED DRY DEMO"
~B,P"O0,0"
~B,P"O1,0"
~B,P"O2,0"
~B,P"O4,0" \INITIALIZE AUX OUTPUT STATES
(O[0,8]=0)
(O[8,4]=0) \INITIALIZE ONBOARD OUTPUTS STATES
.E1 \PROMPT FOR SPEED
P"RETRACT MANDRELS AND SETUP GEARING"
~B,P"O1,1"      \RETRACT THE MANDRELS
~B,P"O0,1"      \AND TURN ON MANDREL SUCK
EX1
EY1 \ ENABLE BOTH AXES MOTION
GYXC+,3         \ GEAR Y TO X COMMAND 3 TO 1 RATIO
P"START BOTH WHEELS JOGGING"
JX+,@V1,/30,\30 \ RUN CAN WHEEL AT SPECIFIED PRECENTAGE SPEED
\JY+,@V1,/75,\75 \RUN PLATE WHEEL AT 3X CAN WHEEL
DB20,1 \ENABLE STATUS DISPLAY
```

BEST AVAILABLE COPY

```
P"HIT ANY KEY TO STOP AND REWIND"
?K1
JX0 \STOP JOGGING X,Y
?SY0
?SX0                \WAIT FOR ALL MOTION TO STOP
GYXC0               \ TURN OFF GEARING
MY-0.06,@99
MX-0.02,@50 \REWIND WHEELS TO PARKING POSITION, SAME AS IN
HOMING ROUTINE
?SX0                \WAIT FOR ALL MOTION TO STOP
?SY0
~B,P"O1,0" \ALL DONE, TURN OFF MANDREL RETRACT VACUUM
~B,P"O0,0" \ALSO TURN OFF MANDREL SUCK
DB20,0 \TURN RUNTIME DISPLAY OFF
P"DONE"
>5 \GO BACK TO MAIN MENU
$80   \ EXIT FROM PROGRAM
P" PROGRAM TERMINATING"
EX0
EY0
>E
```

What is claimed is:

1. A decorator for applying an image to objects using a flexographic process, comprising:

a) a first printing plate mounted on a first support structure, at least a first portion of said image being formed on said first printing plate;

b) carrying means for carrying said objects into contact with said first printing plate, said carrying means including a mandrel adapted to be inserted into one of said objects;

c) compliant support means for supporting said carrying means on a second support structure, said compliant support means having pneumatic means for imparting compliancy thereto, said pneumatic means including a piston operating within a piston cylinder;

d) a shaft for driving rotation of said mandrel;

e) a support plate for supporting said shaft;

f) a first source of pressurized air;

g) means for placing said piston cylinder in flow communication with said first pressurized air source, whereby air in said piston cylinder from said first pressurized air source provides compliancy for said compliant support means; and h) a support frame having means for slidably supporting said support plate thereon, said piston and piston cylinder mounted on said support frame, said piston operatively coupled to said support plate.

2. The decorator according to claim 1, wherein said support frame has a hole formed therein, and wherein said means for slidably supporting said support plate on said support frame comprises a rod connected to said support plate and sliding within said hole in said support frame.

3. The decorator according to claim 1, further comprising a motor for driving rotation of said shaft, said motor mounted in said support frame.

4. The decorator according to claim 1, wherein contact between said object and said printing plate imposes a first moment on said shaft, and further comprising means for imparting a second moment to said shaft adapted to counteract said first moment.

5. The decorator according to claim 4, wherein said shaft has first and second ends, said first end connected to said mandrel, and wherein said moment imparting means comprises means for applying a force to said second end of said shaft.

6. The decorator according to claim 5, further comprising:

a) a first sprocket formed on said second end of said shaft;

b) a motor for driving rotation of said shaft, a second sprocket operatively coupled to said motor; and c) flexible power transmission means coupled to said first and second sprockets.

7. The decorator according to claim 6, wherein said force applying means comprises a tensioner for said flexible power transmission means.

8. The decorator according to claim 1, further comprising:

a) an air tight support housing mounted on said support plate and enclosing at least a portion of said shaft;

b) a vacuum source in flow communication with said support housing;

c) a first passage formed in said shaft in flow communication with said support housing; and d) a second passage formed in said mandrel in flow communication with said first passage and with said object in which said mandrel is inserted, whereby said vacuum source applies a vacuum for retaining said object on said mandrel.

9. A decorator for applying an image to objects using a flexographic process, comprising:

a) a first printing plate mounted on a first support structure, at least a first portion of said image being formed on said first printing plate;

b) carrying means for carrying said objects into contact with said first printing plate; and c) compliant support means for supporting said carrying means on a second support structure, said compliant support means having:

(i) pneumatic means for imparting compliancy thereto;

(ii) first and second spring rates each indicative of a different degree of compliancy of said compliant support means; and (iii) means for switching between said first and second spring rates of said compliant support means.

10. The decorator according to claim 9, further comprising a second printing plate mounted on a second support structure, and wherein:

a) said carrying means having means for carrying said objects along a path so as to place said objects into contact with said second printing plate after having placed said objects into contact with said first printing plate; and b) said switching means has means for switching between said first and second spring rates depending on the location of said carrying means on said path, whereby said compliant support means has said first spring rate when said carrying means places said objects into contact with said first printing plate and said second spring rate when said carrying means places said objects into contact with said second printing plate.

11. A decorator for applying an image to objects using a flexographic process, comprising a) a first printing plate mounted on a first support structure, at least a first portion of said image being formed on said first printing plate;

b) carrying means for carrying said objects into contact with said first printing plate;

c) compliant support means for supporting said carrying means on a second support structure, said compliant support means having:

(i) pneumatic means for imparting compliancy thereto, said pneumatic means including a piston operating within a piston cylinder, and (ii) first and second spring rates each indicative of a different degree of compliancy of said compliant support means;

d) a first source of pressurized air; and e) means for placing said piston cylinder in flow communication with said first pressurized air source, whereby air in said piston cylinder from said first pressurized air source provides compliancy for said compliant support means;

f) a second source of pressurized air; and g) means for placing said second pressurized air source in flow communication with said piston cylinder, said first and second pressurized air sources containing air at first and second pressures, respectively, whereby said compliant support means has said first spring rate when said first pressurized air source is in communication with said piston cylinder and has said second spring rate when said second pressurized air source is in flow communication with said piston cylinder.

12. The decorator according to claim 11, wherein said means for placing said first pressurized air source in flow communications with said piston cylinder and said means for placing said second pressurized air source in flow communication with said piston cylinder comprise valve means capable of assuming first and second states, said first state placing said first pressurized air source in flow communication with said piston cylinder and said second state placing said second pressurized air source in flow communication with said piston cylinder, and further comprising means for actuating said valve means so as to place said valve means into either said first or second states.

13. A decorator for applying an image to approximately cylindrical objects using a flexographic process, comprising:

a) upper and lower printing plates mounted on upper and lower members for rotation about first and second axes, respectively, first and second portions of said image being formed on said first and second printing plates, respectively;

b) a support structure adapted to rotate about a third axis, thereby bring said objects into contact with said first and second printing plates;

c) a first mandrel for holding said objects on said support structure during said contact with said printing plates;

first compliant support means for supporting said first mandrel on said support structure, said first compliant support means having first pneumatic means supplied with air at first and second pressures for imparting compliancy at first and second spring rates thereto; and e) means for switching between said first and second pressures at which air is supplied to said first compliant support means depending on the circumferential location of said mandrel about said third axis.

14. The decorator according to claim 13, wherein said support structure comprises a central shaft having a plurality of spokes extending radially outward therefrom, a second mandrel supported at the distal end of each of said spokes by a second compliant support means, each of said second compliant support means having second pneumatic means supplied with air at said first and second pressures for imparting compliancy at said first and second spring rates thereto.

15. The decorator according to claim 14, wherein said first and each of said second pneumatic means comprises a piston operating within a piston cylinder.

16. The decorator according to claim 15, wherein each of said first and second compliant means comprises:

a) a support frame on which said piston cylinder is mounted;

b) a support plate on which said mandrel is mounted; and c) a guide rod connected to said support plate and slidably mounted on said support frame, said piston coupled to said guide rod.

17. The decorator according to claim 14, further comprising:

a) a motor for driving rotation of said support structure operatively coupled to said central shaft;

b) an encoder coupled to said motor and adapted to generate a pulsed signal in response to rotation thereof; and c) wherein said switching means comprises an electronic controller adapted to receive said pulsed signal and having means for determining said circumferential location of said mandrel about said third axis by counting said pulses in said signal.

18. A decorator for applying an image to approximately cylindrical objects using a flexographic process, comprising:

a) a first plate wheel having a first printing plate mounted thereon, a first portion of said image being formed on said first printing plate;

b) a second plate wheel having a second printing plate mounted thereon, a second portion of said image being formed on said second printing plate;

c) a mandrel cluster having a shaft and a plurality of mandrels circumferentially spaced around said shaft, each of said mandrels adapted to support one of said objects, said mandrels circumferentially spaced around said shaft so as to place said objects supported thereon sequentially into contact with said first printing plate followed by contact with said second printing plate;

d) first and second plate wheel motors operatively connected to rotate said first and second plate wheels, respectively, a mandrel cluster motor operatively connected to rotate said mandrel cluster, and a mandrel motor for each of said mandrels operatively connected to rotate its respective mandrel; and e) an electronic controller programmed with logic for controlling rotation of each of said motors; whereby said first and second portions of said image are transferred to the surface of said objects.

19. The decorator according to claim 18, further comprising an encoder for each of said motors adapted to generate a pulsed signal in response to rotation thereof.

20. The decorator according to claim 19, wherein said electronic controller has logic means for synchronizing each of said mandrel motors to said first and second plate wheel motors so that said objects and said printing plates have substantially the same surface speed while said objects are in contact with said printing plates.

21. The decorator according to claim 20, wherein said logic means comprises means for comparing said pulsed signals from each of said encoders.

22. The decorator according to claim 19, wherein said electronic controller has means for placing said first and second plate wheels in registration with said mandrel cluster so that initial contact between each of said objects and said first and second printing plates occurs at a predetermined location on said printing plates.

23. The decorator according to claim 22, wherein said registration means comprises:

a) indexing means for generating an index signal when said first and second plate wheels and said mandrel cluster each reach a respective predetermined circumferential position; and b) logic means for comparing said pulsed signals from each of said first and second plate wheel and said mandrel cluster motor encoders.

* * * * *